US008976097B2

(12) United States Patent
Lee et al.

(10) Patent No.: US 8,976,097 B2
(45) Date of Patent: Mar. 10, 2015

(54) DRIVING APPARATUS AND DISPLAY DRIVING SYSTEM INCLUDING THE SAME

(75) Inventors: Woo-nyoung Lee, Seoul (KR); Hyun-sang Park, Seongnam-si (KR); Seong-young Ryu, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 190 days.

(21) Appl. No.: 13/600,739

(22) Filed: Aug. 31, 2012

(65) Prior Publication Data

US 2013/0100004 A1 Apr. 25, 2013

(30) Foreign Application Priority Data

Oct. 24, 2011 (KR) ..... 10-2011-0108804

(51) Int. Cl.
*G09G 3/36* (2006.01)

(52) U.S. Cl.
CPC ..... *G09G 3/3614* (2013.01); *G09G 3/3696* (2013.01)
USPC ..... 345/89; 345/96

(58) Field of Classification Search
None
See application file for complete search history.

(56) References Cited

U.S. PATENT DOCUMENTS

| | | | | |
|---|---|---|---|---|
| 7,319,450 | B2 * | 1/2008 | Choi | 345/92 |
| 2007/0242024 | A1 * | 10/2007 | Sung | 345/100 |
| 2007/0257897 | A1 | 11/2007 | Tang | |
| 2008/0180427 | A1 * | 7/2008 | Nishimura | 345/209 |
| 2009/0102777 | A1 * | 4/2009 | Izumikawa et al. | 345/96 |
| 2009/0109198 | A1 * | 4/2009 | Kim et al. | 345/204 |
| 2012/0092322 | A1 * | 4/2012 | Enjou et al. | 345/211 |

FOREIGN PATENT DOCUMENTS

| | | | |
|---|---|---|---|
| JP | 2007-219200 | A | 8/2007 |
| KR | 10-2004-0049172 | A | 6/2004 |

* cited by examiner

*Primary Examiner* — Srilakshmi K Kumar
*Assistant Examiner* — Sardis Azongha
(74) *Attorney, Agent, or Firm* — Lee & Morse, P.C.

(57) ABSTRACT

A driving apparatus and a display driving system. The driving apparatus includes a first amplification unit receiving a first signal and outputting a driving signal of a positive polarity voltage with respect to a reference voltage, a second amplification unit receiving a second signal and outputting a driving signal of a negative polarity voltage with respect to the reference voltage, and a controller for determining a chopping signal applied to a chopping terminal of the second amplification unit such that an offset polarity of an output voltage of the first amplification unit and an offset polarity of an output voltage of the second amplification unit are the same.

19 Claims, 12 Drawing Sheets

<Nth frame>

<N+1th frame>

<Nth frame>

<N+1th frame>

DRIVING APPARATUS AND DISPLAY DRIVING SYSTEM INCLUDING THE SAME

CROSS-REFERENCE TO RELATED APPLICATIONS

This application claims the benefit of Korean Patent Application No. 10-2011-0108804, filed on Oct. 24, 2011, in the Korean Intellectual Property Office, the disclosure of which is incorporated herein in its entirety by reference.

BACKGROUND

1. Field

The inventive concept relates to a driving apparatus for generating a driving voltage of a display panel and a display driving system including the driving apparatus, and more particularly, to a driving apparatus capable of reducing image quality deterioration due to an offset of an amplifier and a display driving system including the driving apparatus.

2. Description of the Related Art

As gradation display performance of a display panel is enhanced, a display driver is required to more precisely apply a driving voltage to the display panel. That is, the narrower spaces between gradation levels are, the more precise a level of the driving voltage the display driver is required to generate. However, since an amplifier for supplying driving voltage to a source line of the display panel exhibits offset characteristics because of its internal characteristics, a positive polarity deviation or a negative polarity deviation between an input voltage and an output voltage of the amplifier occurs. In addition, such a deviation due to the offset characteristics may vary according to amplifiers, and thus amplifiers of the display driver may generate driving voltages having different voltage levels although the same voltage is input into the amplifiers. The deviation characteristics due to offsets of amplifiers included in a display driver cause a stripe phenomenon on a display screen, which greatly deteriorates display quality.

SUMMARY

According to an aspect of the inventive concept, there is provided a driving apparatus including a first amplification unit receiving a first signal and outputting a driving signal of a positive polarity voltage with respect to a reference voltage, a second amplification unit receiving a second signal and outputting a driving signal of a negative polarity voltage with respect to the reference voltage, and a controller for determining a chopping signal applied to a chopping terminal of the second amplification unit such that an offset polarity of an output voltage of the first amplification unit and an offset polarity of an output voltage of the second amplification unit are the same.

The first amplification unit and the second amplification unit may operate as comparators and output voltages indicating offset directions in a set mode, and operate as buffers and output driving voltages corresponding to gradation voltages applied to the first amplification unit and the second amplification unit in an operation mode.

The controller may apply the chopping signal corresponding to an offset direction of the first amplification unit to the chopping terminal of the second amplification unit, and store a local chopping signal corresponding to an offset direction of the second amplification unit in a set mode, and apply the local chopping signal to the chopping terminal of the second amplification unit in a operation mode.

The controller may include: a latch unit for storing a local chopping signal indicating an offset direction of the second amplification unit; and a chopping signal selection unit for selecting the chopping signal applied to the chopping terminal of the second amplification unit.

In a set mode, the chopping signal selection unit may select an output voltage of the first amplification unit as the chopping signal of the second amplification unit, and the latch unit may store an output voltage of the second amplification unit as the local chopping signal.

In an operation mode, the chopping signal selection unit may select the local chopping signal stored in the latch unit as the chopping signal of the second amplification unit.

Each of the first amplification unit and the second amplification unit may include an amplifier for generating a driving voltage and a plurality of switches for controlling connections between input terminals and an output terminal of the amplifier, wherein the amplifier operates as a comparator or a buffer according to on/off states of the plurality of switches.

Each of the first amplification unit and the second amplification unit may operate as a comparator by connecting two input terminals of the amplifier in a set mode.

Each of the first amplification unit and the second amplification unit may operate as a buffer by connecting one input terminal of the amplifier to the output terminal in the operation mode.

The first amplification unit and the second amplification unit may be set as first type buffers or second type buffers according to logic levels of chopping signals applied to the first amplification unit and the second amplification unit in an operation mode.

The first amplification unit and the second amplification unit may be set as the first type buffers by connecting second input terminals and output terminals of the amplifiers included in the first amplification unit and the second amplification unit when chopping signals applied to chopping terminals of the amplifiers are first logic levels, and are set as the second type buffers by connecting first input terminals and output terminals of the amplifiers when the chopping signals are second logic levels.

The reference voltage may be a common voltage applied to a common electrode of pixel cells of a liquid crystal display (LCD) apparatus.

According to another aspect of the inventive concept, there is provided a display driving system including: a driving apparatus including a first amplification unit applied to drive a positive polarity voltage with respect to a reference voltage, a second amplification unit applied to drive a negative polarity voltage with respect to the reference voltage and a controller for determining a logic level of a chopping signal applied to a chopping terminal of the second amplification unit in such a way that an offset polarity of an output voltage of the first amplification unit and an offset polarity of an output voltage of the second amplification unit are the same; an input voltage generation unit for generating a first gradation voltage corresponding to a driving voltage of a first source line and a second gradation voltage corresponding to a driving voltage of a second source line, and transferring the first gradation voltage or the second gradation voltage to the first amplification unit or the second amplification unit in response to a control signal; and an output control unit for applying an output voltage of the first amplification unit to the first source line and applying an output voltage of the second amplification unit to the second source line in response to the control signal, and applying the output voltage of the first amplification unit to the first source line and applying the output voltage of the second amplification unit to the second source line in response to a negative control signal.

The controller may apply the chopping signal according to an offset direction of the first amplification unit to the chopping terminal of the second amplification unit, and store a local chopping signal corresponding to an offset direction of the second amplification unit in a set mode, and apply the local chopping signal to the chopping terminal of the second amplification unit in an operation mode.

The control signal may transmit between a first logic level and a second logic level every time a gate line of a liquid crystal display (LCD) apparatus is scanned and every frame.

According to another aspect of the inventive concept, there is provided a display driving apparatus a first amplification unit receiving a first signal and outputting a driving signal of a positive polarity voltage with respect to a reference voltage, the first amplification unit having a first intrinsic offset polarity, a second amplification unit receiving a second signal and outputting a driving signal of a negative polarity voltage with respect to the reference voltage, the second amplification unit having a second intrinsic offset polarity, and a controller connected to the second amplification unit and switchably connected to the first amplification unit, the controller compensating for a difference between the first and second intrinsic offset polarities such that an offset polarity of an output voltage of the second amplification unit is a same polarity as the first intrinsic offset polarity, even when the first and second intrinsic offset polarities are different.

The controller may include a selector and a storage device.

In a set mode, the selector may connect an output of the first amplification unit to the second amplification unit and the storage device may store an output of the second amplification unit, and, in an operation mode, the selector may connect the storage device to the second amplification unit.

The first amplification unit and the second amplification unit may operate as comparators and respectively output voltages indicating the first and second intrinsic offset polarities in a set mode, and may operate as buffers and output driving voltages corresponding to gradation voltages applied to the first amplification unit and the second amplification unit in an operation mode.

The first amplification unit may be a fixed type buffer and the second amplification unit may be one of a first or second type buffer according to the difference between the first and second intrinsic offset polarities.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
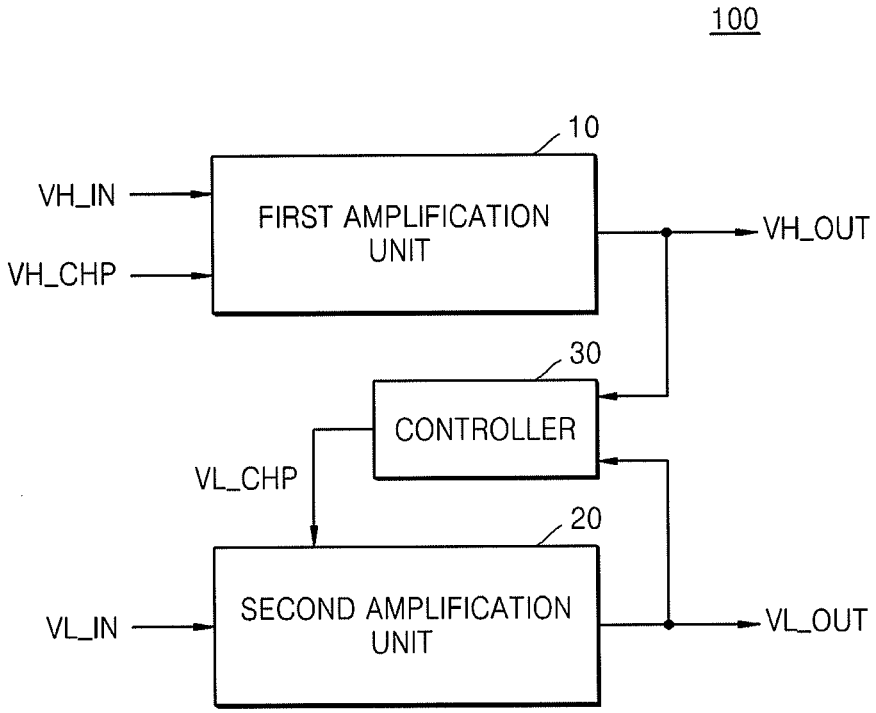
FIG. 1 illustrates a block diagram illustrating a driving apparatus according to an embodiment of the inventive concept.

Hereinafter, the inventive concept will be described more fully with reference to the accompanying drawings, in which exemplary embodiments of the inventive concept are shown. The inventive concept may, however, be embodied in many different forms and should not be construed as limited to the exemplary embodiments set forth herein. Rather, these embodiments are provided so that this disclosure will be thorough and complete, and will fully convey the scope of the invention to those of ordinary skill in the art. The same reference numerals represent the same elements throughout the drawings.

The terminology used herein is for the purpose of describing particular embodiments only and is not intended to be limiting of the inventive concept. As used herein, the singular forms 'a', 'an' and 'the' are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term 'and/or' includes any and all combinations of one or more of the associated listed items. Expressions such as "at least one of," when preceding a list of elements, modify the entire list of elements and do not modify the individual elements of the list.

It will be understood that, although the terms 'first', 'second', 'third', etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 illustrates a block diagram of a driving apparatus 100 according to an embodiment of the inventive concept.

Referring to FIG. 1, the driving apparatus 100 may include a first amplification unit 10, a second amplification unit 20, and a controller 30.

The first amplification unit 10 receives a first input voltage VH_IN and a chopping signal VH_CHP, and generates and outputs a positive polarity driving voltage with respect to a reference voltage. The first input voltage VH_IN is a gradation voltage corresponding to a driving voltage of a source line for driving a positive polarity voltage with respect to the reference voltage, e.g., a common voltage Vcom applied to a pixel cell.

The second amplification unit 20 receives a second input voltage VL_IN and a chopping signal VL_CHP, and generates and outputs a negative polarity driving voltage with respect to the reference voltage. The second input voltage VL_IN is a gradation voltage corresponding to a driving voltage of a source line for driving a negative polarity voltage with respect to the reference voltage.

The controller 30 determines and applies the chopping signal VL_CHP to a chopping terminal of the second amplification unit 20 in such a way that an offset polarity of an output voltage VH_OUT of the first amplification unit 10 and an offset polarity of an output voltage VL_OUT of the second amplification unit 20 are the same.

The driving apparatus 100 of the present embodiment uses the controller 30 to allow the first amplification unit 10 and the second amplification unit 20 to have the same the offset polarity, thereby preventing image quality deterioration due to an offset of a driving voltage that may occur due to an offset deviation of the amplifiers. The driving apparatus 100 may generate the driving voltage through a set mode and an operation mode.

In the set mode, the first amplification unit 10 and the second amplification unit 20 operate as comparators. The output voltages VH_OUT and VL_OUT respectively output by the first amplification unit 10 and the second amplification unit 20 operating as comparators indicate offset directions of the first amplification unit 10 and the second amplification unit 20 with respect to the chopping signals VL_CHP and VL_CHP, respectively. The controller 30 applies a signal having a logic level corresponding to the offset direction of the first amplification unit 10, i.e., a signal having a logic level corresponding to the output voltages VH_OUT of the first amplification unit 10, to the second amplification unit 20 as the chopping signal VL_CHP, and accordingly receives and stores a signal having a logic level corresponding to the offset direction of the second amplification unit 20.

In the operation mode, the first amplification unit 10 and the second amplification unit 20 operate as buffers. The controller 30 allows offset polarity of the output voltages VH_OUT and VL_OUT respectively generated and output by the first amplification unit 10 and the second amplification unit 20 to be the same by applying the signal stored in the set mode as the chopping signal VL_CHP of the second amplification unit 20.

Figure 2:
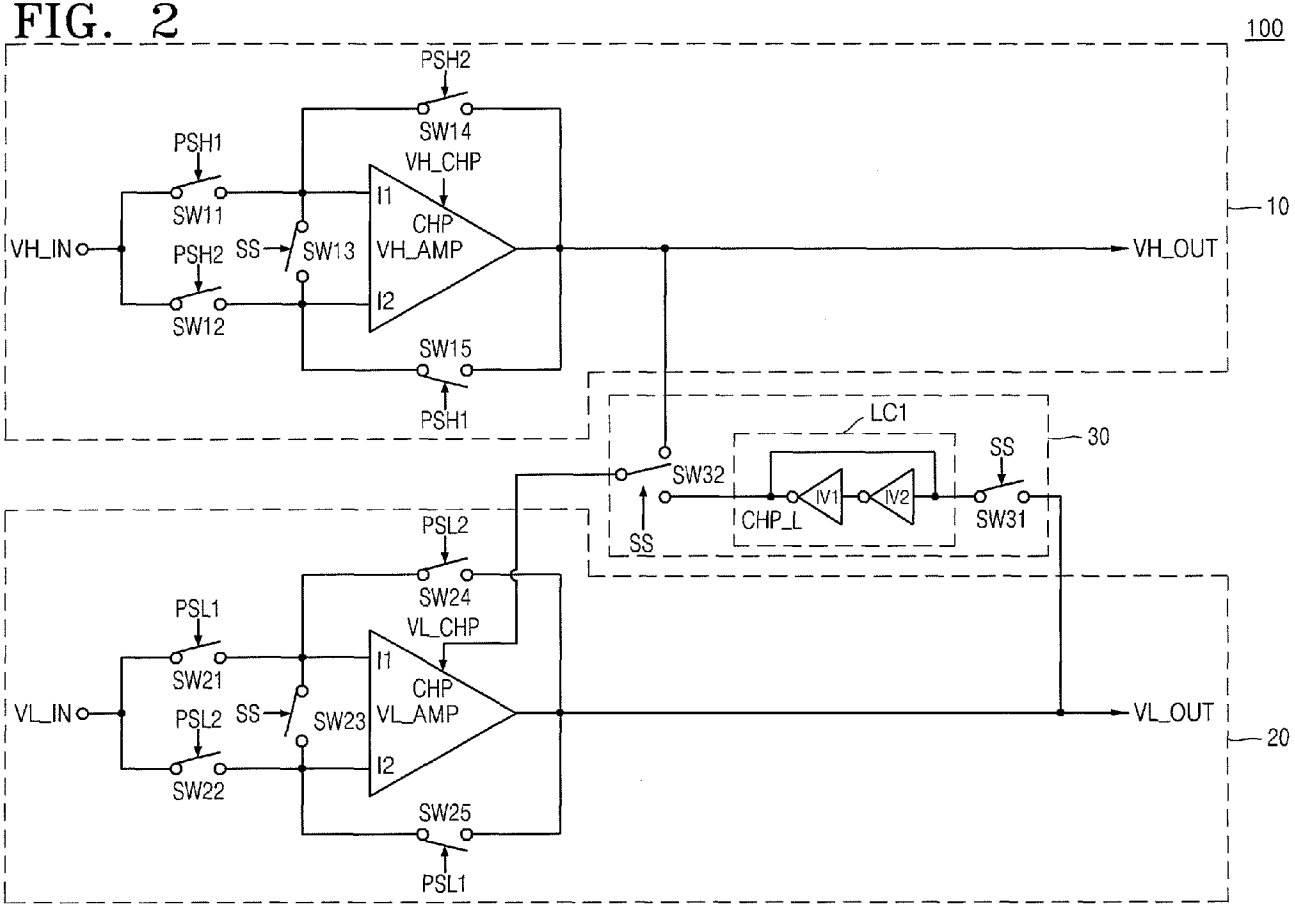
FIG. 2 illustrates a circuit diagram of the driving apparatus of FIG. 1.

FIG. 2 is a circuit diagram of the driving apparatus 100 of FIG. 1 according to an embodiment.

Referring to FIG. 2, the first amplification unit 10 includes a first amplifier VH_AMP and a plurality of switches SW11, SW12, SW13, SW14, and SW15 for controlling connections of input and output terminals of the first amplifier VH_AMP. The second amplification unit 20 includes a second amplifier VL_AMP and a plurality of switches SW21, SW22, SW23, SW24, and SW25 for controlling connections of input and output terminals of the second amplifier VL_AMP. The controller 30 includes a chopping signal selection unit SW32, a latch unit LC1, and a switch SW31.

The first amplifier VH_AMP and the second amplifier VL_AMP generate voltages having opposite polarities with respect to the reference voltage. The first amplifier VH_AMP generates a positive polarity voltage with respect to the reference voltage. The second amplifier VL_AMP generates a negative polarity voltage with respect to the reference voltage. The first amplifier VH_AMP and the second amplifier VL_AMP are a pair of amplifiers for alternately driving a source line in response to a control signal. A method of driving a liquid crystal panel according to the control signal will be described in detail later with reference to FIGS. 7 through 11.

The first amplifier VH_AMP and the second amplifier VL_AMP each include two input terminals I1 and I2 and a chopping signal terminal CHP. The first amplifier VH_AMP and the second amplifier VL_AMP may be configured as differential amplifiers for amplifying and outputting a difference between voltages applied to the first input terminal I1 and the second input terminal I2. The first amplifier VH_AMP and the second amplifier VL_AMP may adjust offset directions thereof by changing connections between transistors thereof according to the chopping signals VH_CHP and VL_CHP applied to the chopping signal terminals CHP. That is, if an offset having a positive polarity deviation occurs when a chopping signal has a first logic level, e.g., a high level, an offset having a negative polarity deviation occurs if the chopping signal is changed to having a second logic level, e.g., a low level.

Although not shown, the first amplifier VH_AMP and the second amplifier VL_AMP operate by each receiving two power voltages. Two power voltages applied to the first amplifier VH_AMP and the second amplifier VL_AMP may differ according to a voltage driving range of each of the first amplifier VL_AMP and the second amplifier VL_AMP. For example, if the voltage driving range of the first amplifier VH_AMP is between VDD and ½*VDD, and the voltage driving range of the second amplifier VL_AMP is between ½*VDD and VSS, the power voltages of the first amplifier VL_AMP may be VDD and ½*VDD, and the power voltages of the second amplifier VL_AMP may be ½*VDD and VSS. However, this is merely exemplary, and the inventive concept is not limited thereto. A power voltage applied to an amplifier may select a variety of ranges in terms of a voltage driving range and a reduction in power consumption.

Switch SW13 of the first amplification unit 10, switch SW23 of the second amplification unit 20, and the chopping signal selection unit SW31 and the switch SW32 of the controller 30 operate in response to a setting signal SS. Switches SW11 and SW15 of the first amplification unit 10 operate in response to a first type operation signal PSH1. Switches SW12 and SW14 of the first amplification unit 10 operate in response to a second type operation signal PSH2. Switches SW21 and SW25 of the second amplification unit 20 operate in response to a first type operation signal PSL1. Switches SW22 and SW24 of the second amplification unit 20 operate in response to a second type operation signal PSL2. By control of these switches (and the chopping signal selection unit SW31), the first amplifier VL_AMP and the second amplifier VL_AMP may operate as comparators in a set mode and may operate as first type buffers or second type buffers in an operation mode.

For example, when, in the set mode, the setting signal SS is a first logic level, e.g., a high level, the switches SW13 and SW23 are turned on so that the first amplifier VH_AMP and the second amplifier VL_AMP operate as comparators. Further, in the set mode, the switch SW32 may connect the output VH_OUT of the first amplifier VH_AMP to the chopping terminal CHP of the second amplifier SL_AMP and the SW21 is turned on. All other switches in the first and second amplifiers may be turned off during the set mode. In other words, the first type operation signals PSH1 and PSL1 and the second type operation signals PSH2 and PSL2 may all be second logic levels, e.g., low levels, in the set mode.

During the operation mode, when the first type operation signals PSH1 and PSL1 are at first logic levels, e.g., high level, the switches SW11, SW15, SW21, and SW25 are turned on, and the first amplifier VH_AMP and the second amplifier VL_AMP operate as first type buffers. Alternatively, when the second type operation signals PSH2 and PSL2 are at first logic levels, e.g., high level, the switches SW12, SW14, SW22, and SW24 are turned on, and the first amplifier VH_AMP and the second amplifier VL_AMP operate as second type buffers. The chopping signals VH_CHP and VL_CHP may control the levels of the operation signals. For example, when the chopping signals VH_CHP and VL_CHP are high levels in the operation mode, the first type operation signals PSH1 and PSL1 are high levels. When the chopping signals VH_CHP and VL_CHP are low levels in the operation mode, the second type operation signals PSH2 and PSL2 are high levels.

The chopping signal selection unit SW32 selects the output voltage VH_OUT of the first amplifier VH_AMP or a local chopping signal CHP_L stored in the latch unit LC1 in response to the setting signal SS and applies the selected output voltage VH_OUT or the local chopping signal CHP_L as the chopping signal VL_CHP of the second amplifier VL_AMP. Although the chopping signal selection unit SW32 is shown as one switch in FIG. 2, the inventive concept is not limited thereto. Various embodiments such as a plurality of switches or a multiplexer may be used as the chopping signal selection unit SW32.

The latch unit LC1 is configured as a plurality of inverters IV1 and IV2. If the switch SW31 is turned on in response to the setting signal SS, the latch unit LC1 receives the chopping signal VL_CHP of the second amplifier VL_AMP and stores it as the local chopping signal CHP_L.

In the set mode, the switches SW13, SW23, and SW31 among the switches SW11, SW12, SW13, SW14, SW15, SW21, SW22, SW23, SW24, SW25, and SW31 are turned on. The first amplifier VH_AMP and the second amplifier VL_AMP operate as comparators since the input terminals I1 and I2 and output terminals of the first amplifier VH_AMP and the second amplifier VL_AMP are not connected. The switches SW13 and SW23 are turned on so that the same voltage is applied to the input terminals I1 and I2 of the first amplifier VH_AMP and the second amplifier VL_AMP. In this case, an output voltage is theoretically "0" if voltages applied to input terminals do not differ. However, outputs of amplifiers actually are one of two power voltages of amplifiers due to mismatch of transistors included in amplifiers. If outputs of amplifiers have a high voltage level between two power voltages, since amplifiers exhibit offset characteristics causing an offset deviation of a positive polarity, logic levels according to offset directions are high levels. If outputs of amplifiers have a low voltage level between two power voltages, since amplifiers exhibit offset characteristics causing an offset deviation of a negative polarity, logic levels according to offset directions are low levels.

In other words, each amplifier may exhibit an intrinsic offset polarity. As described in detail below, if these intrinsic offset polarities are different in the first amplifier VH_AMP and the second amplifier VL_AMP, an offset polarity of the second amplifier VL_AMP may be controlled such that it is the same as that of the intrinsic offset polarity of the first amplifier VH_AMP.

An optional logic level signal is applied to the first amplifier VH_AMP as the chopping signal VH_CHP. That is, a desired signal between a high level and a low level may be applied to the first amplifier VH_AMP. The output voltage VH_OUT of the first amplification unit 10, i.e. the logic level according to the offset direction, is applied as the chopping signal VL_CHP of the second amplifier VL_AMP through the chopping signal selection unit SW32. Since the switch SW31 in the controller 30 is turned on, the output voltage VL_OUT of the second amplifier VL_AMP is stored in the latch unit LC1 as the local chopping voltage CHP_L.

In the operation mode, the set signal is at the second logic level, e.g., low level, such that switches SW13, SW23, and SW31 are turned off and the chopping signal selection unit SW32 now connects the latch unit LC1 to the second amplifier VL_AMP. In particular, the local chopping voltage CHP_L stored in the latch unit LC1 in the set mode is applied to the second amplifier VL_AMP as the chopping signal VL_CHP through the chopping signal selection unit SW32.

The first amplifier VH_AMP and the second amplifier VL_AMP are set as first type buffers or second type buffers in accordance to the chopping signals VH_CHP and VL_CHP respectively applied to the chopping terminals VHP of the first amplifier VH_AMP and the second amplifier VL_AMP. For example, if the local chopping voltage CHP_L of a high level is stored in the latch unit LC1 during the set mode and is then applied as the chopping signal VL_CHP of the second amplifier VL_AMP in the operation mode, the switches SW22, SW23, and SW24 are turned off, and the switches SW21 and SW25 are turned on. Thus, the second amplifier VL_AMP operates as a first type buffer, i.e., the output terminal is connected to the second input terminal 12 and the gradation voltage VL_IN is applied to the first input terminal I1. If the chopping signal VL_CHP applied to the second amplifier VL_AMP is a low level, the switches SW21, SW23, and SW25 are turned off, and the switches SW22 and SW24 are turned on. Thus, the second amplifier VL_AMP operates as a second type buffer, i.e., the output terminal is connected to the first input terminal I1 and the gradation voltage VL_IN is applied to the second input terminal I2. The first amplifier VH_AMP is also set as the first type buffer or the second type buffer according to the logic level of the chopping signal VH_CHP. This is the same as described with reference to the second amplifier VL_AMP, and thus a detailed description thereof will not be repeated.

The first amplifier VH_AMP and the second amplifier VL_AMP generate driving voltages corresponding to gradation voltages VH_IN and VL_IN respectively applied thereto after being set as the first or second type buffers. The output voltages VH_OUT and VL_OUT of the first amplifier VH_AMP and the second amplifier VH_AMP respectively are driving voltages thereof. The driving voltages generated by the first amplifier VH_AMP and the second amplifier VL_AMP have the same offset deviation in the same offset polarity.

Figure 3A:
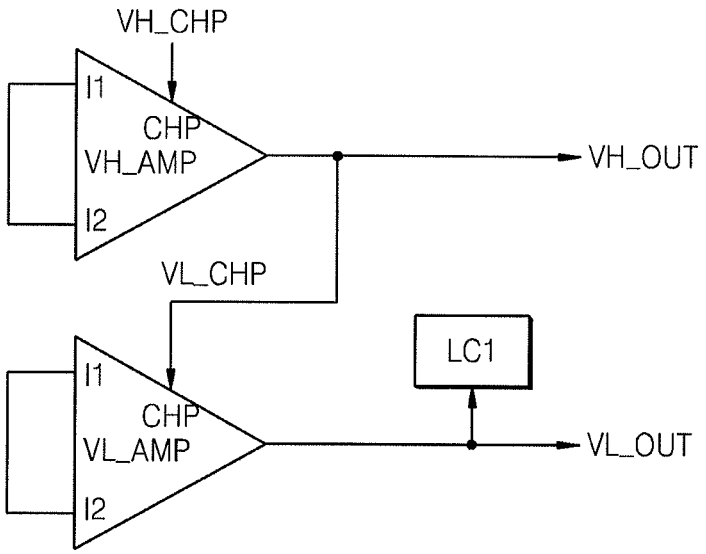
FIGS. 3A through 3E illustrate circuit diagrams for explaining an operation of a driving apparatus according to an embodiment of the inventive concept.

The operation of the driving apparatus 100 according to the inventive concept will now be described in detail with reference to FIGS. 3A through 3E below. FIG. 3A is a circuit diagram of the driving apparatus 100 in the set mode. FIGS. 3B through 3E are circuit diagrams of the driving apparatus 100 in the operation mode.

Referring to FIG. 3A, the first amplifier VH_AMP and the second amplifier VH_AMP operate as comparators. A signal having a logic level corresponding to the output voltage VH_OUT generated by the first amplifier VH_AMP is applied as the chopping signal VL_CHP of the second amplifier VL_AMP. A signal having a logic level corresponding to the output voltage VL_OUT generated by the second amplifier VL_AMP is stored in the latch unit LC1 as the local chopping signal CHP_L.

Figure 3B:
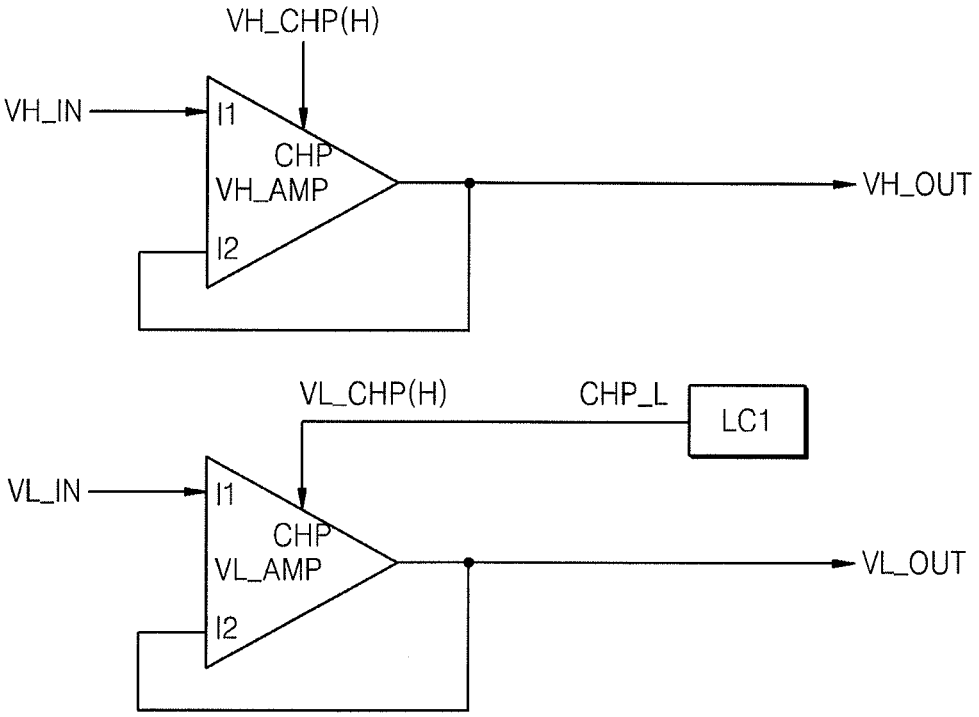

Referring to FIG. 3B, the first amplifier VH_AMP and the second amplifier VH_AMP are set as first type buffers in the operation mode. In this case, voltage relationships in the set mode and the operation mode are shown in Table 1 below.

TABLE 1

| | MODE | VH_CHP | VH_OUT | VL_CHP | VL_OUT | CHP_L |
|---|---|---|---|---|---|---|
| Case 1 | SET | H | H | H | H | H |
| | OPER-ATION | H | + | H | + | H |
| Case 2 | SET | H | L | L | H | H |
| | OPER-ATION | H | − | H | − | H |

In the set mode and operation mode, a voltage applied to the first amplifier VL_AMP as the chopping signal VH_CHP is high level. When the output voltage VH_OUT of the first amplifier VH_AMP is high level in the set mode, the chopping signal VL_CHP is high level, and the output voltage VL_OUT of the second amplifier VL_AMP may be also high level. When the output voltage VH_OUT is low level, a voltage applied as the chopping signal VH_CHP of the second amplifier VL_AMP is low level, and the output voltage VL_OUT thereof may be high level. Thus, in both cases 1 and 2 above, the first amplifier VH_AMP and the second amplifier VL_AMP have the same offset direction of the output voltages VH_OUT and the VL_OUT with respect to the chopping signals V11 CHP and VL_CHP. In this regard, the local chopping signal CHP_L stored in the latch unit LC1 is high level.

In the operation mode, the local chopping signal CHP_L is applied as the chopping signal VL_CHP of the second amplifier VL_AMP. Thus, the chopping signal VL_CHP of the second amplifier VL_AMP is high level. In FIG. 3B, since voltages applied to the chopping terminals CHP of the first amplifier VH_AMP and the second amplifier VL_AMP are high levels, the first amplifier VL_AMP and the second amplifier VL_AMP are set as first type buffers. In the operation mode of Table 1 above, the first amplifier VL_AMP and the second amplifier VL_AMP have the same offset polarity of the output voltages VH_OUT and the VL_OUT thereof.

Figure 3C:
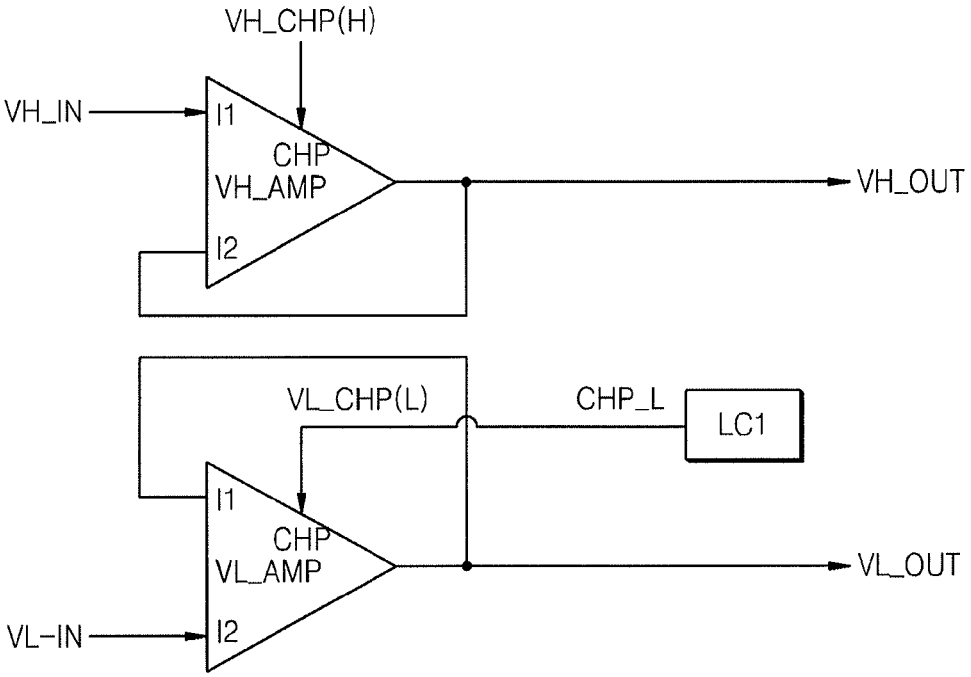

Referring to FIG. 3C, the first amplifier VL_AMP and the second amplifier VL_AMP are set as a first type buffer and a second type buffer, respectively, in an operation mode. In this case, voltage relationships in a set mode and the operation mode are shown in Table 2 below.

TABLE 2

| | MODE | VH_CHP | VH_OUT | VL_CHP | VL_OUT | CHP_L |
|---|---|---|---|---|---|---|
| Case 3 | SET | H | H | H | L | L |
| | OPER-ATION | H | + | L | + | L |
| Case 4 | SET | H | L | L | L | L |
| | OPER-ATION | H | − | L | − | L |

In the set mode and operation mode of Table 2 above, the chopping signal VH_CHP applied to the first amplifier VH_AMP is high level, and the first amplifier VH_AMP and the second amplifier VL_AMP may have different offset directions of the output voltages VH_OUT and the VL_OUT with respect to the chopping signals VH_CHP and VL_CHP in both cases 3 and 4 of Table 2 above. In this regard, the local chopping signal CHP_L stored in the latch unit LC1 is low level. In the operation mode of FIG. 3C, a voltage applied as the chopping signal VH_CHP of the first amplifier VH_AMP is high level and thus the first amplifier VH_AMP is set as the first type buffer. A voltage applied as the chopping signal VL_CHP of the second amplifier VL_AMP is the local chopping signal CHP_L stored in the set mode, i.e., low level, and thus the second amplifier VL_AMP is set as the second type buffer. In the operation mode of Table 2 above, the first amplifier VH_AMP and the second amplifier VL_AMP have the same offset polarity of the output voltages VH_OUT and the VL_OUT thereof.

Figure 3D:
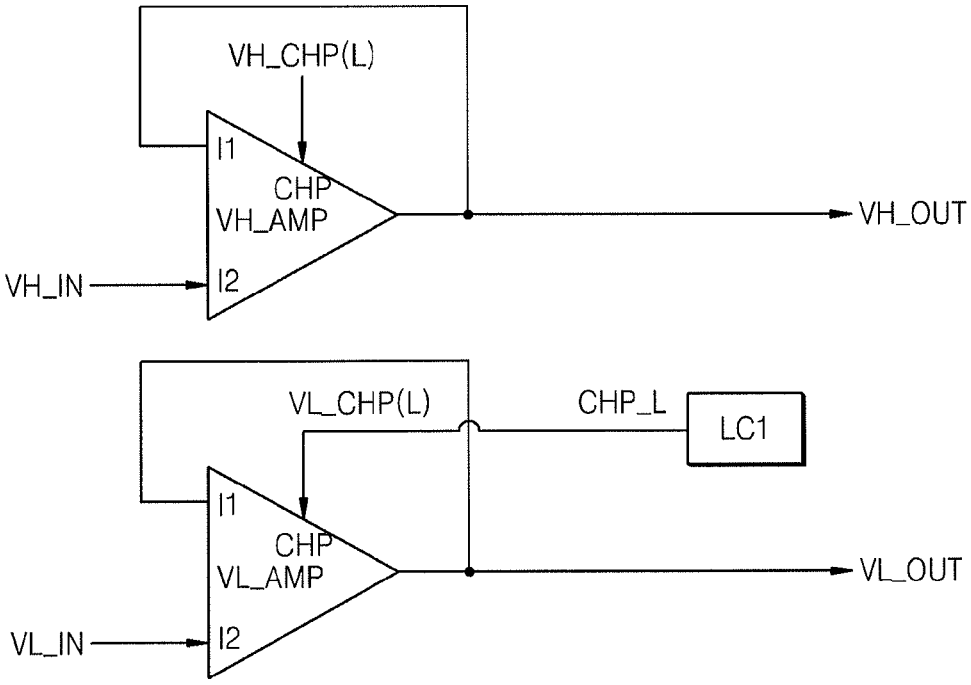

Referring to FIG. 3D, both the first amplifier VH_AMP and the second amplifier VL_AMP are set as second type buffers in an operation mode. In this case, voltage relationships in a set mode and the operation mode are shown in Table 3 below.

TABLE 3

| | STATE | VH_CHP | VH_OUT | VL_CHP | VL_OUT | CHP_L |
|---|---|---|---|---|---|---|
| Case 5 | SET | L | H | H | L | L |
| | OPER-ATION | L | + | L | + | L |
| Case 6 | SET | L | L | L | L | L |
| | OPER-ATION | L | − | L | − | L |

A voltage applied as the chopping signal VH_CHP of the first amplifier VH_AMP is low level both in the set mode and the operation mode. The first amplifier VL_AMP and the second amplifier VL_AMP may have the same offset direction of the output voltages VH_OUT and the VL_OUT with respect to the chopping signals VH_CHP and VL_CHP in both cases 5 and 6 of Table 3 above. In this regard, the local chopping signal CHP_L stored in the latch unit LC1 is low level. In the operation mode of FIG. 3D, voltages applied as the chopping signals VH_CHP and VL_CHP of the first amplifier VH_AMP and the second amplifier VL_AMP are low levels, and thus the first amplifier VH_AMP and the second amplifier VL_AMP are set as the second type buffers. In the operation mode of Table 3 above, the first amplifier VH_AMP and the second amplifier VL_AMP have the same offset polarity of the output voltages VH_OUT and the VL_OUT thereof.

Figure 3E:
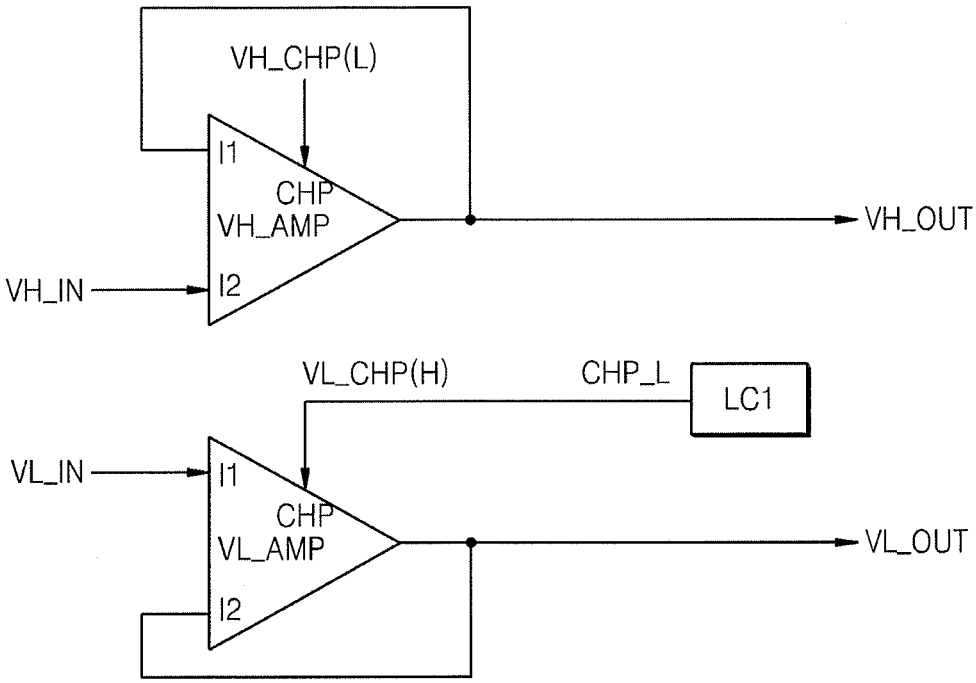

Referring to FIG. 3E, the first amplifier VH_AMP and the second amplifier VL_AMP are set as a second type buffer and a first type buffer, respectively, in an operation mode. In this case, voltage relationships in a set mode and the operation mode are shown in Table 4 below.

TABLE 4

| | STATE | VH_CHP | VH_OUT | VL_CHP | VL_OUT | CHP_L |
|---|---|---|---|---|---|---|
| Case 7 | SET | L | H | H | H | H |
| | OPER | L | + | H | + | H |
| Case 8 | SET | L | L | L | H | H |
| | OPER | L | − | H | − | H |

In the set mode and the operation mode of Table 4 above, the chopping signal VH_CHP applied to the first amplifier VH_AMP is low level, and the first amplifier VH_AMP and the second amplifier VL_AMP may have different offset directions of the output voltages VH_OUT and the VL_OUT with respect to the chopping signals VH_CHP and VL_CHP in both cases 7 and 8 of Table 4 above. In this regard, the local chopping signal CHP_L stored in the latch unit LC1 is high level. In the operation mode of FIG. 3E, a voltage applied as the chopping signal VH_CHP of the first amplifier VH_AMP is low level and thus the first amplifier VH_AMP is set as the second type buffer. A voltage applied as the chopping signal VL_CHP of the second amplifier VL_AMP is high level and thus the second amplifier VL_AMP is set as the first type buffer. In the operation mode of Table 4 above, the first amplifier VH_AMP and the second amplifier VL_AMP have the same offset polarity of the output voltages VH_OUT and the VL_OUT thereof.

According to the embodiments of the inventive concept described with reference to FIGS. 1 through 3E, driving voltages generated by allowing a pair of the first amplifier VH_AMP and the second amplifier VL_AMP to have the same offset polarity may lead to a reduction in image quality deterioration due to offset. This will be described with reference to FIGS. 4 and 5.

Figure 4:
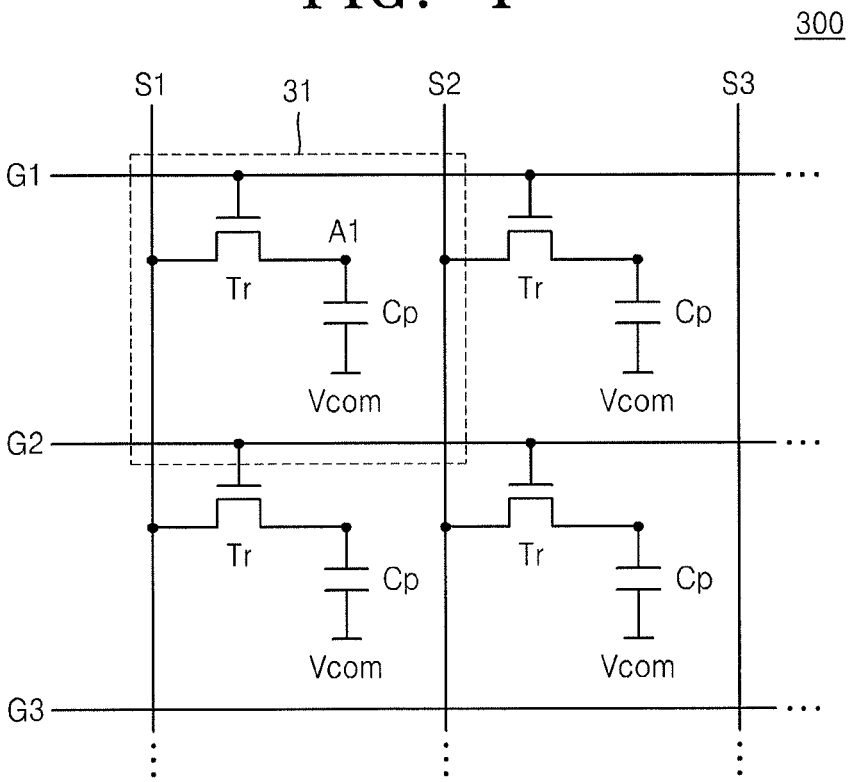
FIG. 4 illustrates an exemplary circuit diagram of a liquid crystal panel.

FIG. 4 is an exemplary circuit diagram of a liquid crystal panel 300. Referring to FIG. 4, the liquid crystal panel 300 includes a plurality of pixel cells 31. Each pixel cell 31 may include a switch transistor Tr and a liquid crystal capacitor Cp. The switch transistors Tr may be turned on and off in response to signals for driving gate lines G1, G2, G3, . . . , and one terminal of each switch transistor Tr may be connected to source lines S1, S2, S3 . . . . The liquid crystal capacitors Cp may be connected between other terminals (i.e. pixel cell electrodes A1) of the switch transistors Tr and a common electrode. A common voltage Vcom is applied to the common electrode.

The gate lines G1, G2, G3, . . . of the liquid crystal panel 300 may be sequentially activated in gate line units in order to transfer image data to each pixel cell 31 thereof. The image data that is applied to the source lines S1, S2, S3, . . . may be transferred to the pixel cell electrodes A1 of the liquid crystal capacitors Cp connected to the activated gate lines.

Liquid crystal is injected between the pixel cell electrodes A1 and the common electrode. When voltages are applied to the pixel cell electrodes A1 and the common electrode, an electric field is formed in the liquid crystal. An image is displayed by adjusting an intensity of the electric field and adjusting an amount of light passing through the liquid crystal. When the electric field is continuously applied to the liquid crystal in one direction, the liquid crystal may be degraded. Thus, a frame inversion method of inverting and driving a polarity of a source voltage (or a data voltage) with respect to the common voltage Vcom per frame is used to prevent the liquid crystal from being degraded. Since the polarity of the source voltage is inverted per frame, a root mean square voltage (Vrms; hereinafter referred to as Vrms) of the voltage applied to both ends of the liquid crystal of the pixel cells 31 is visually output.

Figure 5:
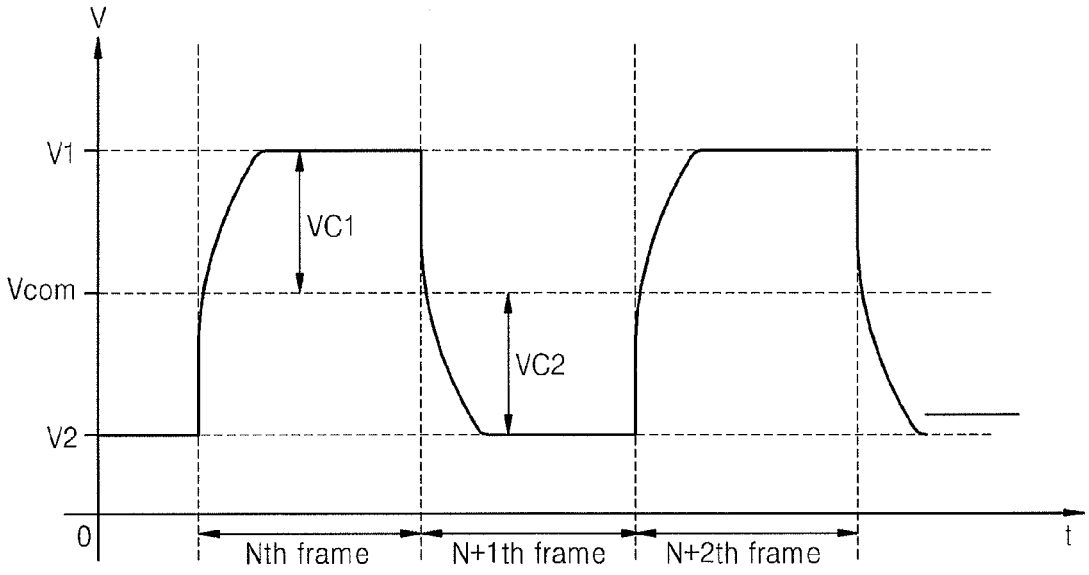
FIG. 5 illustrates a graph for explaining driving voltages applied to pixel cells of the liquid crystal panel of FIG. 4 with respect to time.

FIG. 5 is a graph for explaining driving voltages applied to the pixel cells 31 of the liquid crystal panel 300 of FIG. 4 with respect to time when a frame inversion method is used.

A waveform of FIG. 5 shows driving voltages applied to the pixel cell electrode A1 of the pixel cell 31 of FIG. 4. A positive polarity voltage V1 is applied with respect to the common voltage Vcom in an Nth frame. A negative polarity voltage V2 is applied with respect to the common voltage Vcom in an N+1th frame. The positive polarity voltage V1 and the negative polarity voltage V2 are alternately applied when frames are changed. Since the common voltage Vcom is always applied to one end of a liquid crystal, if the positive polarity voltage VC1 is applied to the pixel cell electrode A1, a voltage applied to both ends of the liquid crystal is a difference VC1 between the positive polarity voltage V1 and the common voltage Vcom, and if the negative polarity voltage V2 is applied to the pixel cell electrode A1, the voltage applied to both ends of the liquid crystal is a difference VC2 between the common voltage Vcom and the negative polarity voltage V2. In this regard, Vrms of the voltage applied to both ends of the liquid crystal is as follows.

$$Vrms = \sqrt{\frac{VC1^2 + VC2^2}{2}} \qquad \text{Equation 1}$$

The positive polarity voltage V1 and the negative polarity voltage V2 that are applied to the pixel cell electrode 31 have offset deviations due to an offset of an amplifier of a drive apparatus. Thus, the Vrms of the voltage applied to both ends of the liquid crystal has a deviation. The smaller the deviation of the Vrms of the voltage, the smaller the offset deviation of the amplifier. The smaller the deviation of the Vrms of the voltage, the more identical the offset polarity of the positive polarity voltage V1 and the negative polarity voltage V2. When the difference VC1 is greater than a target value as a positive offset of the positive polarity voltage V1 occurs, since the difference VC2 is smaller than the target value as a positive offset deviation of the negative polarity voltage V2 occurs, the deviation of the Vrms applied to both ends of the liquid crystal is reduced. That is, if offset polarity of the positive polarity voltage V1 and the negative polarity voltage V2 are the same, the deviation of the Vrms of the voltage applied to both ends of the liquid crystal may be reduced by reducing an average offset. Thus, an influence of the offset of the amplifier of the driving apparatus may be reduced.

Figure 6:
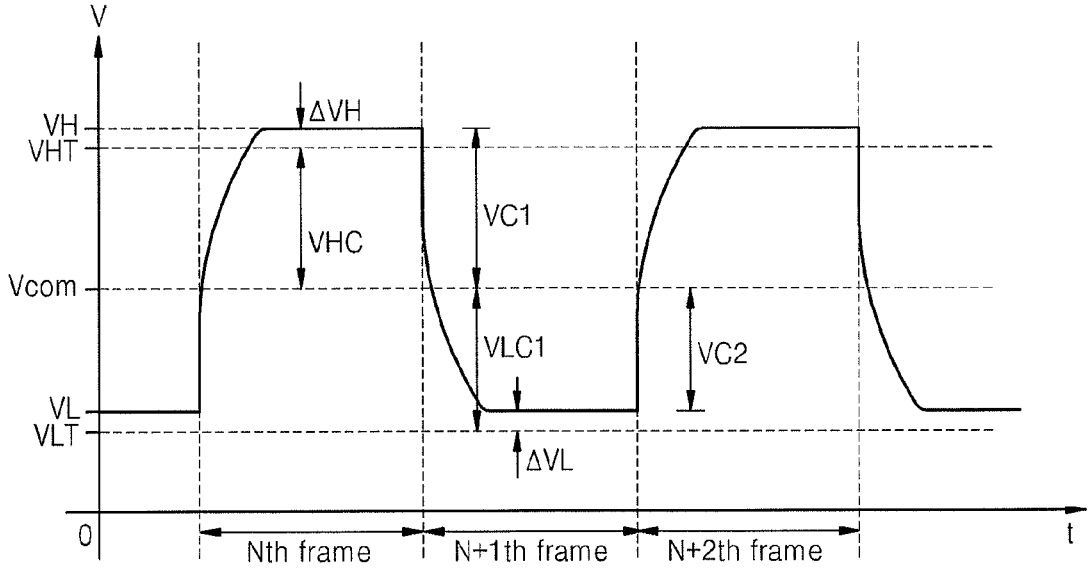
FIG. 6 illustrates a graph for explaining driving voltages applied to pixel cells of a liquid crystal panel according to an embodiment of the inventive concept.

FIG. 6 is a graph for explaining driving voltages applied to the pixel cells 31 of the liquid crystal panel according to an embodiment of the inventive concept. Referring to FIG. 6, a positive polarity voltage VH is applied to the pixel cells 31 in an Nth frame, and a negative polarity voltage VL is applied to the pixel cells 31 in an N+1th frame. The positive polarity voltage VH and the negative polarity voltage VL are alternately applied when frames are changed. Although a target voltage is VHT, the positive polarity voltage VH that rises by ΔVH due to an offset of the first amplifier VH_AMP is applied. The second amplifier VL_AMP drives driving voltages of the pixel cells 31 in the N+1th frame. Although a target voltage is VLT, the negative polarity voltage VL that rises by ΔVL due to an offset of the second amplifier VL_AMP is applied. The output voltages of the first amplifier VH_AMP and the second amplifier VL_AMP have the same offset polarity according to the inventive concept. Thus, the positive polarity voltage VH and the negative polarity voltage VL have values that rise by ΔVH and ΔVL compared to the target voltages VHT and VLT. In this regard, the voltage VC1 applied to both ends of the pixel cells 31 in the Nth frame is VHC+ΔVH, and the voltage VC2 applied to both ends of the pixel cells 31 in the N+1th frame is VLC−ΔVL. Thus, Vrms of the voltage applied to both ends of the pixel cells 31 is as follows:

$$Vrms = \sqrt{\frac{(VHC + \Delta VH)^2 + (VLC - \Delta VL)^2}{2}} \qquad \text{Equation 2}$$

When no offset occurs, the Vrms of the voltage is as follows:

$$Vrms = \sqrt{\frac{VHC^2 + VLC^2}{2}} \quad \text{Equation 3}$$

Although, as can be seen be comparing Equations 2 and 3, the Vrms of the voltage increases due to the offset, such an increase by ΔVH is offset by a reduction by ΔVL.

If the first amplifier VH_AMP and the second amplifier VL_AMP have opposite offset polarity, and the negative polarity voltage VL is reduced by ΔVL compared to the target voltage VLT in the N+1th frame, the voltage VC2 applied to both ends of the pixel cells 31 in the N+1th frame is VLC+ΔVL. In this regard, the Vrms of the voltage applied to both ends of the pixel cells 31 is as follows;

$$Vrms = \sqrt{\frac{(VHC + \Delta VH)^2 + (VLC + \Delta VL)^2}{2}} \quad \text{Equation 4}$$

A deviation of the Vrms of the voltage is greater than a deviation in the same offset polarity since an increase by ΔVL is added to the increase by ΔVH.

Therefore, if a positive polarity amplifier and a negative polarity amplifier for driving the pixel cells 31 have the same offset polarity according to the embodiment of the inventive concept, a deviation of Vrms of voltages applied to pixels may be reduced.

Figure 7:
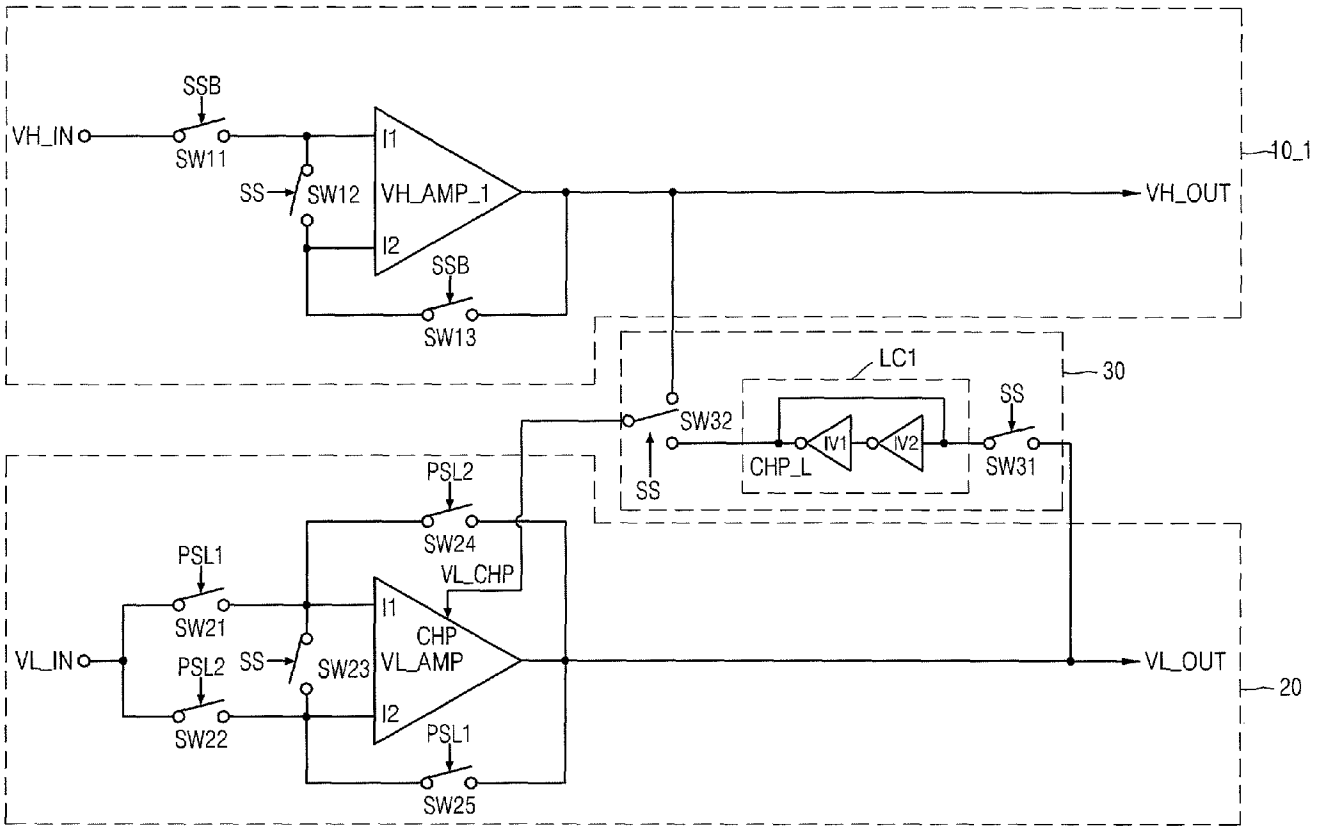
FIG. 7 illustrates a circuit diagram of a driving apparatus according to another embodiment of the inventive concept.

FIG. 7 is a circuit diagram of a driving apparatus 100_*a* according to another embodiment of the inventive concept. Referring to FIG. 7, the driving apparatus 100_*a* includes a first amplification unit 10_1, the second amplification unit 20, and the controller 30.

The first amplification unit 10_1 includes the first amplifier VH_AMP, and the switches SW11, SW12, and SW13 for controlling connections between input and output terminals of the first amplifier VH_AMP according to a set mode and an operation mode of the first amplifier VH_AMP. The switch SW12 is turned on when the setting signal SS is high level. Thus, the first amplifier VH_AMP operates as a comparator in the set mode. The switches SW11 and SW13 are turned on when a supplementary setting signal SSB is high level. Thus, the first amplifier VH_AMP operates as a buffer in the operation mode.

The second amplification unit 20_1 includes the second amplifier VL_AMP, and the switches SW21, SW22, SW23, SW24, and SW25 for controlling connections between input and output terminals of the second amplifier VL_AMP. The controller 30 includes the chopping signal selection unit SW32, the latch unit LC1, and the switch SW31. The operations of the second amplification unit 20 and the controller 30 are the same as those described with reference to the driving apparatus 100 of FIG. 2, and thus detailed descriptions thereof will be omitted here.

A method of generating driving voltages in the driving apparatus 100_1 of FIG. 7 is the same as that described with reference to the driving apparatus 100 of FIG. 2. In a set mode, the first amplifier VL_AMP and the second amplifier VL_AMP operate as comparators so that a signal having a logic level corresponding to an offset direction of the first amplifier VH_AMP is applied to the second amplification unit 20 as the chopping signal VL_CHP. Accordingly a signal having a logic level corresponding to an offset direction of the second amplifier VL_AMP is stored in the latch unit LC1 as the local chopping signal CHP_L. In an operation mode, the local chopping signal CHP_L is applied as the chopping signal VH_CHP of the second amplifier VL_AMP, and the switches SW21, SW22, SW23, SW24, and SW25 are controlled according to the logic level of the chopping signal VL_CHP of the second amplifier VL_AMP so that the second amplifier VL_AMP is set as a first type buffer or a second type buffer.

However, unlike the first amplifier VH_AMP of the driving apparatus 100 of FIG. 2, the first amplifier VH_AMP of the driving apparatus 100_*a* of FIG. 7 does not receive the chopping signal VH_CHP. Thus, the first amplifier VH_AMP may be set as one type buffer. That is, it is impossible to change connections between transistors of the driving apparatus 100_*a* of FIG. 7 according to the chopping signal VH_CHP. The operations of the second amplifier VL_AMP, the latch unit LC1, and the switches SW21, SW22, SW23, SW24, and SW25 are the same as described with reference to the driving apparatus 100 of FIG. 2.

If the first amplifier VH_AMP of the driving apparatus 100_*a* of FIG. 7 is turned on, the second input terminal 12 and an output terminal are connected, and a gradation voltage VH_IN is applied to the first input terminal I1. This is the same as a state of the first type buffer. Thus, the operation of the driving apparatus 100_*a* of FIG. 7 is the same as described with reference to FIGS. 3A through 3C.

Figure 8:
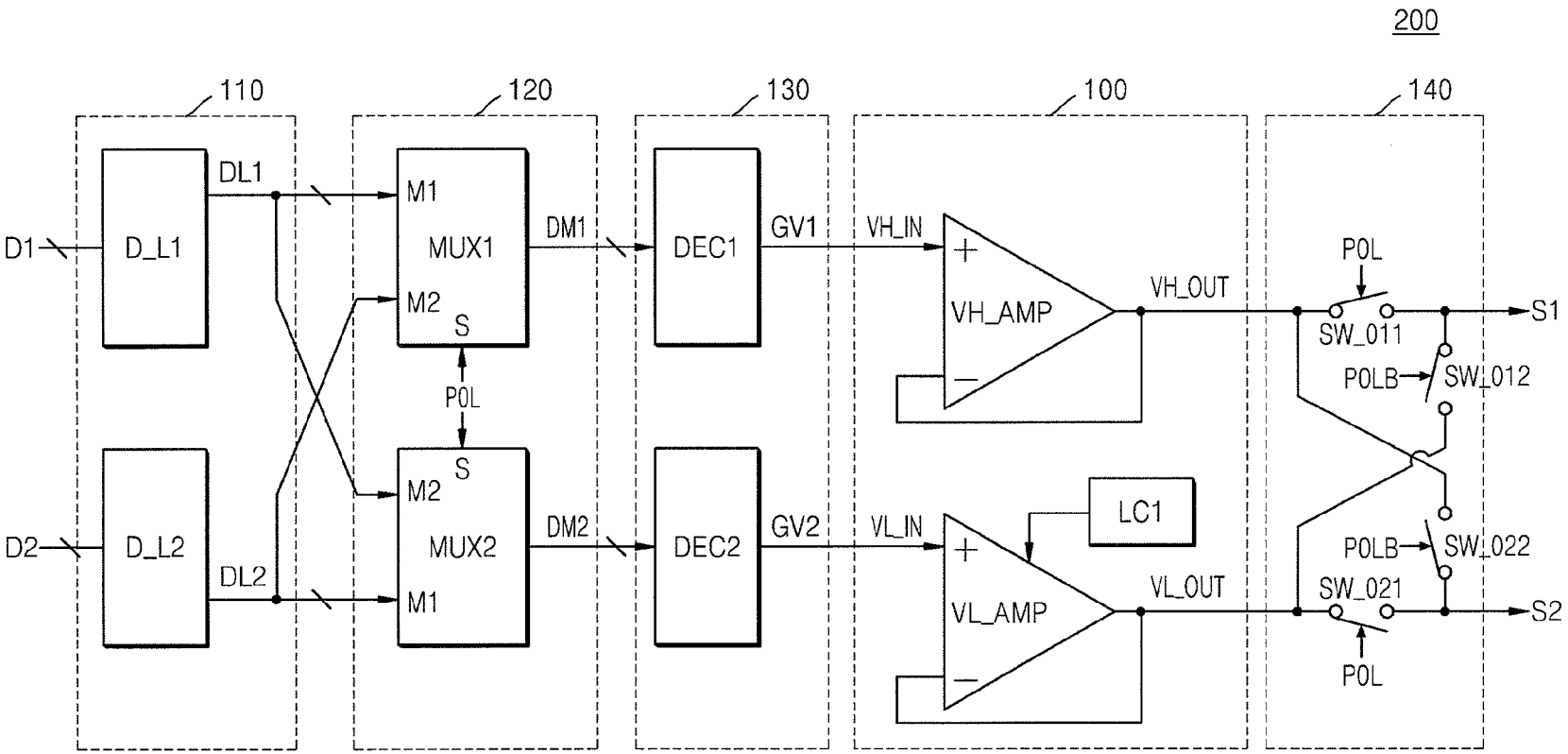
FIG. 8 illustrates a circuit diagram of a display driving system according to an embodiment of the inventive concept.

FIG. 8 is a circuit diagram of a display driving system 200 according to an embodiment of the inventive concept. Referring to FIG. 8, the display driving system 200 includes a data latch unit 110, a selection unit 120, a conversion unit 130, the driving apparatus 100, and an output control unit 140.

The data latch unit 110, the selection unit 120, and the conversion unit 130 generate a gradation voltage corresponding to a driving voltage of a first source line of the driving apparatus 100 and a gradation voltage corresponding to a driving voltage of a second source line thereof, and transfer the gradation voltages to a first amplification unit or a second amplification unit in response to control signals.

More specifically, the data latch unit 110 includes a first latch D_L1 and a second latch D_L2, stores image data D1 and D2 applied from the outside of a liquid crystal display (LCD) apparatus or output by a memory, and outputs the image data D1 and D2 as latch data DL1 and DL2. The image data D1 and D2 are data including a plurality of bits.

The selection unit 120 includes a first multiplexer MUX1 and a second multiplexer MUX2. The first multiplexer MUX1 and the second multiplexer MUX2 both receive the data DL1 and DL2 output by the data latch unit 110, select one of the latch data DL1 and DL2 in response to a control signal POL, and output the selected data as selection data DM1 and DM2. The first multiplexer MUX1 receives the first latch data DL1 at a first input terminal M1 and the second latch data DL2 at a second input terminal M2. The second multiplexer MUX2 receives the first latch data DL1 at the second input terminal M2 and the second latch data DL2 at the first input terminal M1. The first multiplexer MUX1 and the second multiplexer MUX2 select and output one of the first latch data DL1 and the second latch data DL2 received at the first input terminal M1 and the second input terminal M2 according to the control signal POL. For example, when the control signal POL is high level, if the first multiplexer MUX1 and the second multiplexer MUX2 select a signal applied to the first input terminal M1, the first multiplexer MUX1 selects and outputs the first latch data DL1, and the second multiplexer MUX2 selects and outputs the second latch data DL2. When the control signal POL is low level, the first multiplexer MUX1 selects and outputs the second latch data DL2, and the second multiplexer MUX2 selects and outputs the first latch data DL1. Thus, the first multiplexer MUX1 and the second multiplexer MUX2 receive the same control signal POL and select and output different signals.

The conversion unit 130 includes a first decoder DEC1 and a second decoder DEC2. The first decoder DEC1 and the second decoder DEC2 of the conversion unit 130 receive the selection data DM1 and DM2 that are bit data, generate and output gradation voltages GV1 and GV2 to be applied as pixel cell voltages of the LCD apparatus. That is, the first decoder DEC1 and the second decoder DEC2 of the conversion unit 130 decode digital data and convert the decoded digital data into analog voltages.

The driving apparatus 100 includes the first amplifier VH_AMP, the second amplifier VL_AMP, and the latch unit LC1. The first amplifier VH_AMP and the second amplifier VL_AMP of the driving apparatus 100 operate as buffers. The first amplifier VH_AMP and the second amplifier VL_AMP receive the gradation voltages GV1 and GV2 from the conversion unit 130 having limited current driving capability, and buffer and output the gradation voltages GV1 and GV2 to source lines Y1 and Y2. That is, a liquid crystal capacitor of the LCD apparatus is driven.

The output control unit 140 includes switches SW_O11, SW_O12, SW_O21, SW_O22. The output control unit 140 receives the control signal POL and a negative control signal POLB having an opposite logic level to the control signal POL, and turns on the first type switches SW_O11, SW_O21 or the second type switches SW_O12, SW_O22. If the first type switches SW_O11, SW_O21 are turned on, the output voltage VH_OUT of the first amplifier VH_AMP is applied to the first source line S1, and the output voltage VL_OUT of the second amplifier VL_AMP is applied to the second source line S2. If the second type switches SW_O12, SW_O22 are turned off, the output voltage VH_OUT of the first amplifier VL_AMP is applied to the second source line S2, and the output voltage VL_OUT of the second amplifier VL_AMP is applied to the first source line S1.

Figure 9A:
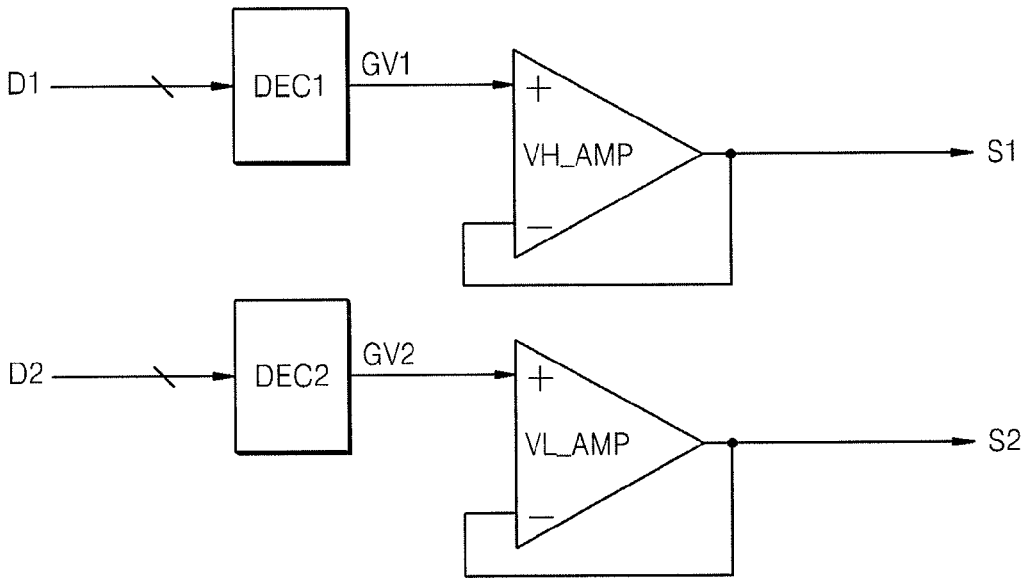
FIGS. 9A and 9B illustrate circuit diagrams for explaining an operation of the display driving system of FIG. 8.
Figure 9B:
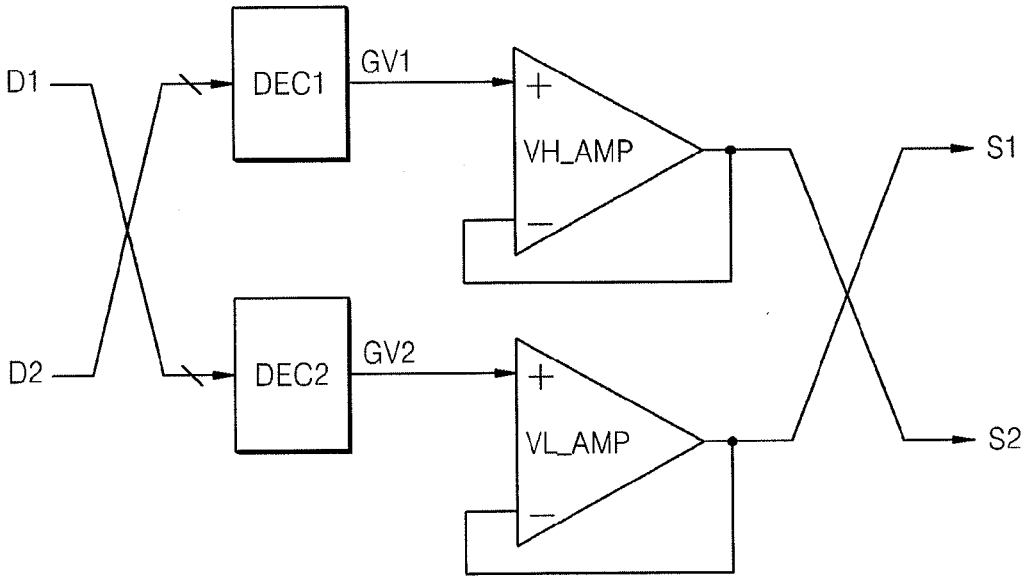

FIGS. 9A and 9B are circuit diagrams for explaining an operation of the display driving system 200 of FIG. 8. FIGS. 9A and 9B illustrate schematic signal flows of generating driving voltages and applying the driving voltages to source lines in the display driving system 200 in an Nth frame and an N+1th frame.

Referring to FIG. 9A, in the Nth frame, the first data D1 is transferred to the first decoder DEC1 and is then converted into the first gradation voltage GV1. The first gradation voltage GV1 is buffered in the first amplifier VL_AMP and is then applied to the first source line S1. The second data D2 is transferred to the second decoder DEC2 and is then converted into the second gradation voltage GV2. The second gradation voltage GV2 is buffered in the second amplifier VL_AMP and is then applied to the second source line S2. Referring to FIG. 8, in the operation of the display driving system 200 of FIG. 9A, the control signal POL is high level. Accordingly, the first multiplexer MUX1 and the second multiplexer MUX2 of the selection unit 120 respectively select the latch data DL1 and DL2 applied to the first input terminal M1 and transfer the selected latch data DL1 and DL2 to the first and second decoders DEC1 and DEC2 of the conversion unit 130. The first type switches SW_O11, SW_O21 are turned on, the output control unit 140 applies the output voltage VH_OUT of the first amplifier VH_AMP to the first source line S1, and the output voltage VL_OUT of the second amplifier VL_AMP to the second source line S2.

Referring to FIG. 9B, in the N+1th frame, the first data D1 is transferred to the second decoder DEC2 and is then converted into the second gradation voltage GV2. The second gradation voltage GV2 is buffered in the second amplifier VL_AMP and is then applied to the first source line S1. The second data D2 is transferred to the first decoder DEC1 and is then converted into the first gradation voltage GV1. The first gradation voltage GV1 is buffered in the first amplifier VH_AMP and is then applied to the second source line S2. Referring to FIG. 8, the operation of the display driving system 200 of FIG. 9B is that the control signal POL is low level. Accordingly, the first multiplexer MUX1 and the second multiplexer MUX2 of the selection unit 120 respectively select the latch data DL1 and DL2 applied to the second input terminal M2 and transfer the selected latch data DL1 and DL2 to the first and second decoders DEC1 and DEC2 of the conversion unit 130. The second type switches SW_O12, SW_O22 are turned on, the output control unit 140 applies the output voltage VL_OUT of the first amplifier VH_AMP to the second source line S2, and the output voltage VL_OUT of the second amplifier VL_AMP to the first source line S1.

In FIG. 8, the control signal POL is inverted per frame. The control signal POL may be inverted when gates are scanned. Voltages applied to source lines are inverted between a positive polarity gradation voltage and a negative polarity gradation voltage at least every frame. Thus, a voltage polarity of each pixel cell is inverted in a frame unit, and polarities of voltages applied to neighboring pixel cells of a liquid crystal panel vary.

Figure 10:
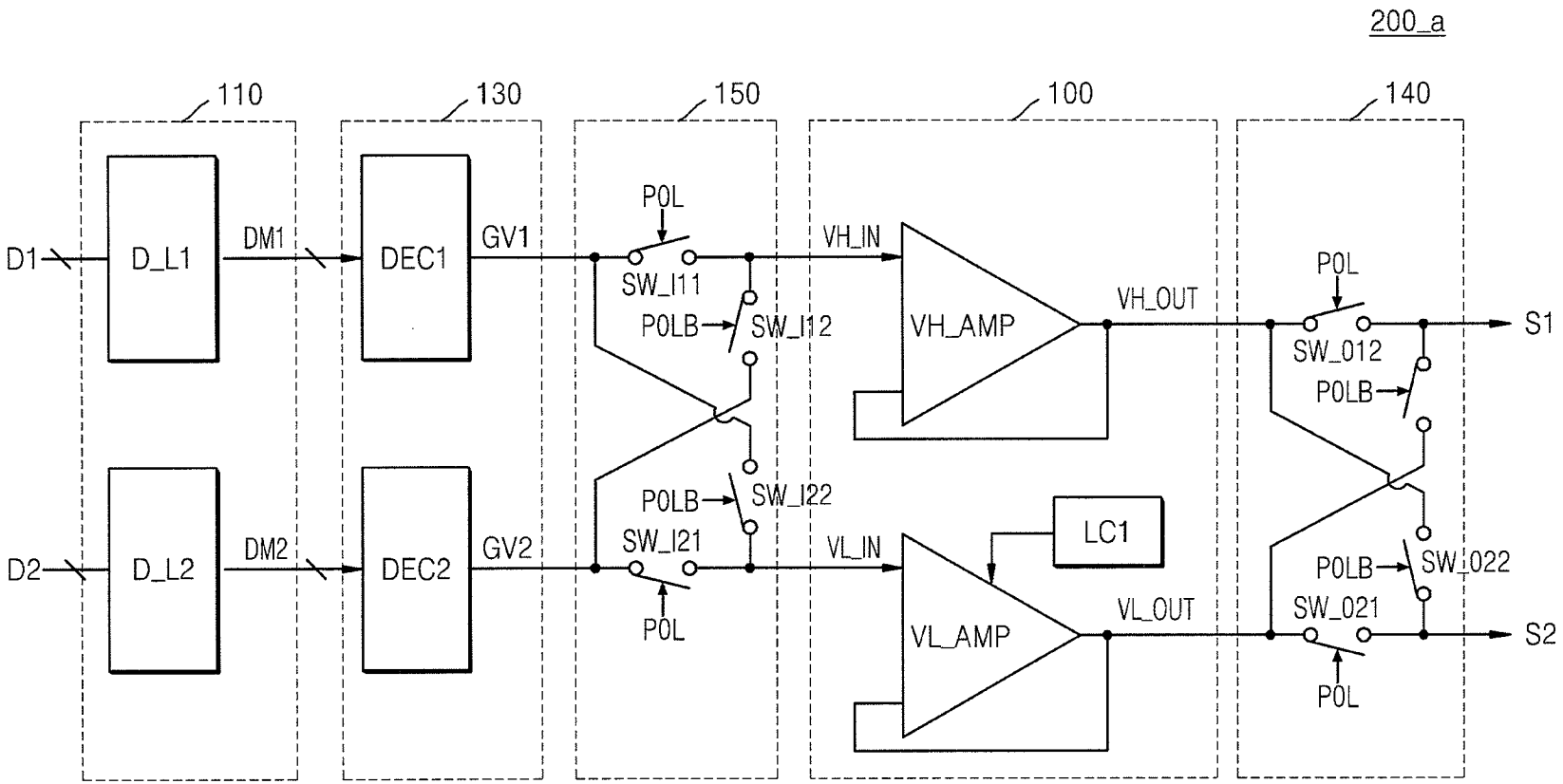
FIG. 10 illustrates a circuit diagram of a display driving system according to another embodiment of the inventive concept.

FIG. 10 is a circuit diagram of a display driving system 200*a* according to another embodiment of the inventive concept. Referring to FIG. 10, the display driving system 200_*a* includes the data latch unit 110, the conversion unit 130, the driving apparatus 100, the output control unit 140, and an input control unit 150.

Comparing the display driving system 200 of FIG. 8 and the display driving system 200_*a* of FIG. 10, referring to FIG. 8, the selection unit 120 is disposed between the data latch unit 110 and the conversion unit 130, and the first multiplexer MUX1 and the second multiplexer MUX2 of the selection unit 120 respectively select one of the latch data DL1 and DL2 in response to the control signal POL, and transfer the selected latch data DL1 and DL2 to the first decoder DEC1 and the second decoder DEC2. However, referring to FIG. 10, the input control unit 150 is disposed between the conversion unit 130 and the driving apparatus 100, and selectively transfers the gradation voltages GV1 and GV2 output by the conversion unit 130 in response to the control signal POL to input terminal VH_IN of the first amplifier VH_AMP or input terminal VH_IN of the second amplifier VL_AMP.

The input control unit 150 may include switches SW_I11, SW_I12, SW_I21, SW_I22. The switches SW_I11, SW_I12, SW_I21, SW_I22 operate in response to the control signal POL and the negative control signal POLB. The first type switches SW_I11, SW_I21 are turned on in response to the control signal POL or the second type signals SW_I21, SW_I22 are turned on in response to the inverted control signal POLB. If the first type switches SW_I11, SW_I21 are turned on, the first gradation voltage GV1 output by the first decoder DEC1 is applied to the first amplifier VL_AMP as an input voltage, and the second gradation voltage GV2 output by the second decoder DEC2 is applied to the second amplifier VL_AMP as the input voltage. If the second type switches SW_I21, SW_I22 are turned on, the first gradation voltage GV1 output by the first decoder DEC1 is applied to the second amplifier VL_AMP as an input voltage, and the second gradation voltage GV2 output by the second decoder DEC2 is applied to the first amplifier VL_AMP as the input voltage.

The operations of the data latch unit 110, the conversion unit 130, the driving apparatus 100, and the output control unit 140 are the same as described with reference to the display driving system 200 of FIG. 8 and thus detailed descriptions thereof will be omitted.

Figure 11A:
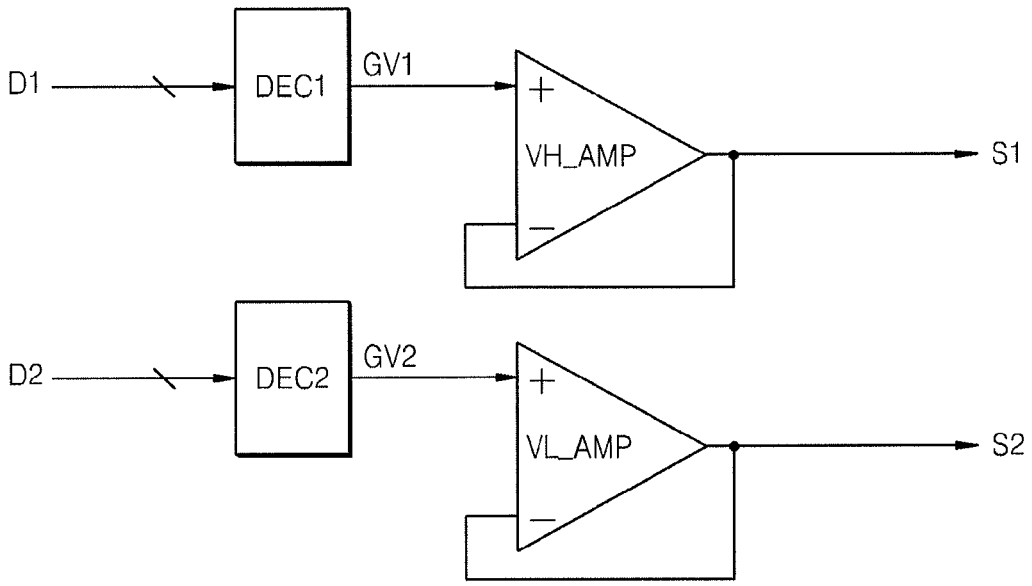
FIGS. 11A and 11B illustrate circuit diagrams for explaining an operation of the display driving system of FIG. 10.
Figure 11B:
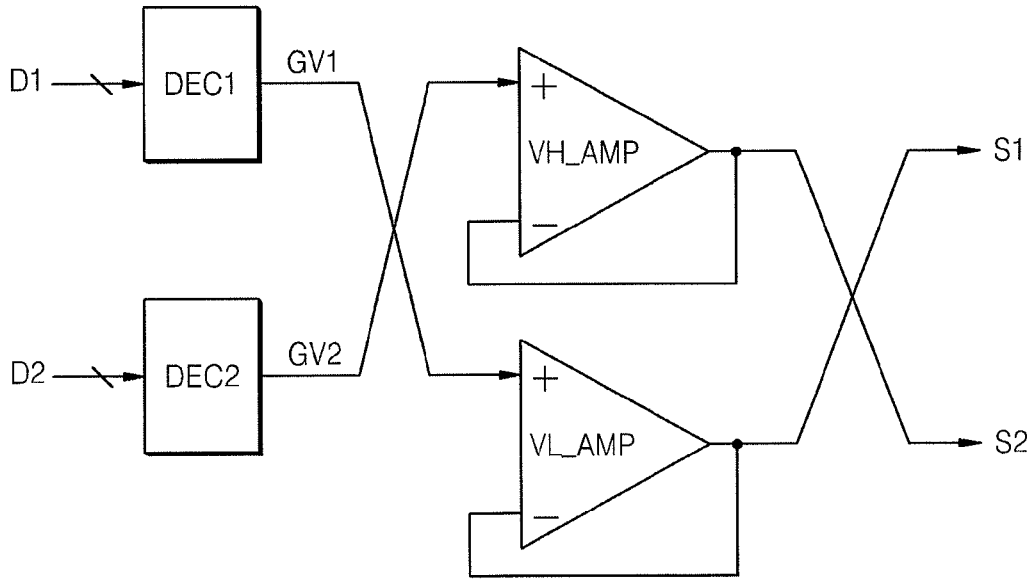

FIGS. 11A and 11B are circuit diagrams for explaining an operation of the display driving system 200_*a* of FIG. 10. FIGS. 11A and 11B illustrate schematic signal flows of generating driving voltages and applying the driving voltages to source lines in the display driving system 200_*a* in an Nth frame and an N+1th frame.

Referring to FIG. 11A, in the Nth frame, the first gradation voltage GV1 output by the first decoder DEC1 is applied to the first amplifier VH_AMP, buffered in the first amplifier VH_AMP, and then applied to the first source line S1. The second gradation voltage GV2 output by the second decoder DEC2 is applied to the second amplifier VL_AMP, is buffered in the second amplifier VL_AMP, and is then applied to the second source line S2. Referring to FIG. 10, in the operation of the display driving system 200_*a* of FIG. 11A, the control signal POL is high level. Accordingly, the first type switches SW_I11, SW_I21 of the input control unit 140 are turned on. Thus, the first gradation voltage GV1 output by the conversion unit 130 is applied to the first amplifier VH_AMP and the second gradation voltage GV2 is applied to the second amplifier VL_AMP. The first type switches SW_O11, SW_O21 are turned on, the output control unit 140 applies the output voltage VH_OUT of the first amplifier VH_AMP to the first source line S1, and the output voltage VL_OUT of the second amplifier VL_AMP to the second source line S2.

Referring to FIG. 11B, in the N+1th frame, the first gradation voltage GV1 output by the first decoder DEC1 is applied to the second amplifier VL_AMP, buffered in the second amplifier VL_AMP, and is then applied to the first source line 51. The second gradation voltage GV2 output by the second decoder DEC2 is applied to the first amplifier VH_AMP, is buffered in the first amplifier VH_AMP, and is then applied to the first source line S1. Referring to FIG. 10, in the operation of the display driving system 200_*a* of FIG. 11B, the control signal POL is high level. Accordingly the second type signals SW_I21, SW_I22 of the input control unit 140 are turned on. Thus, the first gradation voltage GV1 output by the conversion unit 130 is applied to the second amplifier VL_AMP, and the second gradation voltage GV2 is applied to the first amplifier VH_AMP. The first type switches SW_O12, SW_O22 are turned on, the output control unit 140 applies the output voltage VH_OUT of the first amplifier VH_AMP to the second source line S2, and the output voltage VL_OUT of the second amplifier VL_AMP to the first source line S1.

Figure 12:
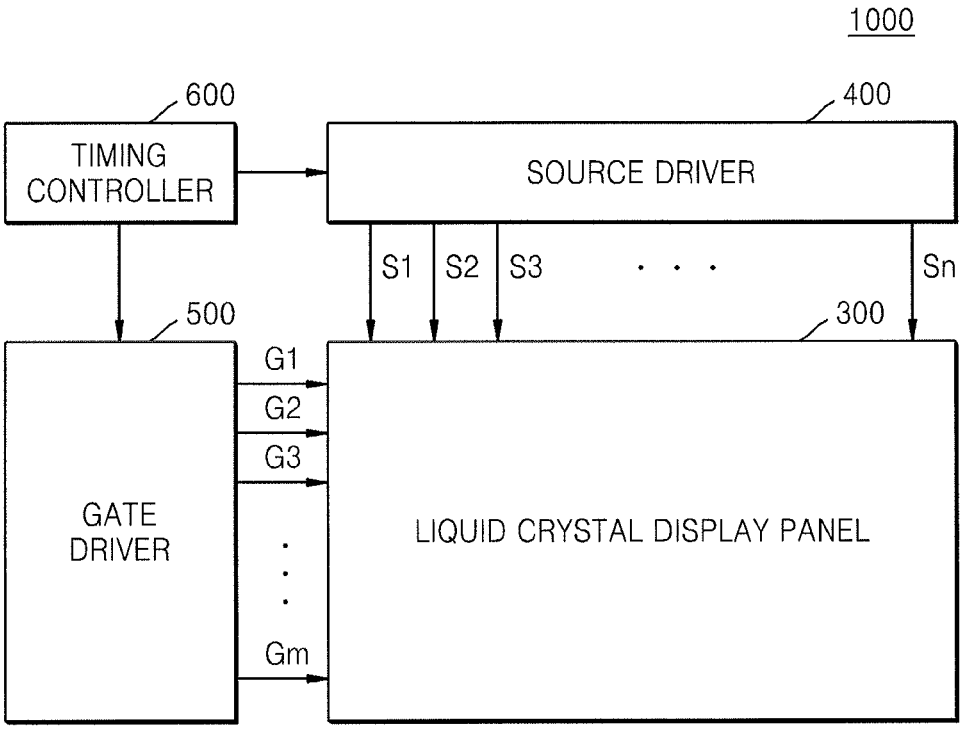
FIG. 12 illustrates a block diagram of a liquid crystal display (LCD) apparatus according to an embodiment of the inventive concept.

FIG. 12 is a block diagram of a LCD apparatus 1000 according to an embodiment of the inventive concept. Referring to FIG. 12, the LCD apparatus 1000 includes the LCD panel 300, a source driver 400, a gate driver 500, and a timing controller 600. The timing controller 600 generates a control signal for controlling the source driver 400 and the gate driver 500, and transmits image data received from the outside to the source driver 400.

The source driver 400 and the gate driver 500 drive the LCD panel 300 according to the control signal provided by the timing controller 600. The gate driver 500 sequentially applies scan signals to row electrodes of the LCD panel 300. Transistors connected to the row electrodes to which the scan signals are applied are sequentially turned on. In this regard, gradation voltages supplied by the source driver 400 are applied to liquid crystal through the transistors connected to the row electrodes to which the scan signals are applied. The source driver 400 may be the display driving system of FIG. 8 including the driving apparatus 100 of FIG. 1. Thus, a pair of an amplifier for generating a positive polarity gradation voltage with respect to a common voltage and an amplifier for generating a negative polarity gradation voltage alternately drives neighboring source lines in response to a control signal. In this regard, a dispersion of Vrms of voltages applied to pixel cells of liquid crystal may be reduced by allowing the positive polarity amplifier and the negative polarity amplifier to have the same offset direction, thereby enhancing display quality of the LCD apparatus 1000.

Meanwhile, the feature of the inventive concept described above may be applied to at least one type of flat panel display apparatus using a similar driving method to that of a LCD apparatus, for example, an electrochromic display (ECD), a digital mirror device (DMD), an actuated mirror device (AMD), a grating light valve (GLV), a plasma display panel (PDP), an electro luminescent display (ELD), a light emitting diode (LED) display, and a vacuum fluorescent display (VFD). The LCD apparatus to which the inventive concept is applied may be applied to a large-screen TV, a high definition television (HDTV), a portable computer, a camcorder, a vehicle display, information and communication multimedia, virtual reality, etc.

By way of summary and review, in accordance with one or more embodiments, by controlling an offset polarity of amplifiers to be the same, thereby reducing an influence due to an offset of a driving amplifier, image quality may be improved.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A driving apparatus, comprising:

a first amplification unit receiving a first signal and outputting a driving signal of a positive polarity voltage with respect to a reference voltage;

a second amplification unit receiving a second signal and outputting a driving signal of a negative polarity voltage with respect to the reference voltage; and a controller configured to apply a chopping signal corresponding to an offset direction of the first amplification unit to a chopping terminal of the second amplification unit such that an offset polarity of an output voltage of the first amplification unit and an offset polarity of an output voltage of the second amplification unit are the same.

2. The driving apparatus as claimed in claim 1, wherein the first amplification unit and the second amplification unit operate as comparators and output voltages indicating offset directions in a set mode, and operate as buffers and output driving voltages corresponding to gradation voltages applied to the first amplification unit and the second amplification unit in an operation mode.

3. The driving apparatus as claimed in claim 1, wherein the controller stores a local chopping signal corresponding to an offset direction of a signal output by the second amplification unit in a set mode, and applies the local chopping signal to the chopping terminal of the second amplification unit in an operation mode.

4. The driving apparatus as claimed in claim 1, wherein the controller comprises:

a latch unit for storing a local chopping signal indicating an offset direction of the second amplification unit; and a chopping signal selection unit for selecting the chopping signal applied to the chopping terminal of the second amplification unit.

5. The driving apparatus as claimed in claim 4, wherein, in a set mode, the chopping signal selection unit selects an output voltage of the first amplification unit as the chopping signal of the second amplification unit, and the latch unit stores an output voltage of the second amplification unit as the local chopping signal.

6. The driving apparatus as claimed in claim 4, wherein, in an operation mode, the chopping signal selection unit selects the local chopping signal stored in the latch unit as the chopping signal of the second amplification unit.

7. The driving apparatus as claimed in claim 1, wherein each of the first amplification unit and the second amplification unit comprises an amplifier for generating a driving voltage and a plurality of switches for controlling connections between input terminals and an output terminal of the amplifier, wherein the amplifier operates as a comparator or a buffer according to states of the plurality of switches.

8. The driving apparatus as claimed in claim 7, wherein each of the first amplification unit and the second amplification unit operates as a comparator by connecting two input terminals of the amplifier in a set mode.

9. The driving apparatus as claimed in claim 7, wherein each of the first amplification unit and the second amplification unit operates as a buffer by connecting one input terminal of the amplifier to the output terminal in an operation mode.

10. The driving apparatus as claimed in claim 1, wherein the first amplification unit and the second amplification unit are set as first type buffers or second type buffers according to logic levels of chopping signals applied to the first amplification unit and the second amplification unit in an operation mode.

11. The driving apparatus as claimed in claim 10, wherein the first amplification unit and the second amplification unit each include an amplifier, the first amplification unit and the second amplification unit being set as the first type buffers by connecting second input terminals and output terminals of the amplifiers when chopping signals applied to chopping terminals of the amplifiers are first logic levels, and are set as the second type buffers by connecting first input terminals and output terminals of the amplifiers when the chopping signals applied to chopping terminals of the amplifiers are second logic levels.

12. The driving apparatus as claimed in claim 1, wherein the reference voltage is a common voltage applied to a common electrode of pixel cells of a liquid crystal display (LCD) apparatus.

13. A display driving system, comprising:

a driving apparatus including a first amplification unit applied to drive a positive polarity voltage with respect to a reference voltage, a second amplification unit applied to drive a negative polarity voltage with respect to the reference voltage and a controller configured to apply a logic level of a chopping signal according to an offset direction of the first amplification unit to a chopping terminal of the second amplification unit such that an offset polarity of an output voltage of the first amplification unit and an offset polarity of an output voltage of the second amplification unit are the same;

an input voltage generation unit for generating a first gradation voltage corresponding to a driving voltage of a first source line and a second gradation voltage corresponding to a driving voltage of a second source line, and transferring the first gradation voltage or the second gradation voltage to the first amplification unit or the second amplification unit in response to a control signal; and an output control unit for applying an output voltage of the first amplification unit to the first source line and applying an output voltage of the second amplification unit to the second source line in response to the control signal, and applying the output voltage of the first amplification unit to the first source line and applying the output voltage of the second amplification unit to the second source line in response to a negative control signal.

14. The display driving system as claimed in claim 13, wherein the controller stores a local chopping signal corresponding to an offset direction of the second amplification unit in a set mode, and applies the local chopping signal to the chopping terminal of the second amplification unit in an operation mode.

15. The display driving system as claimed in claim 13, wherein the control signal transmits between a first logic level and a second logic level every time a gate line of a liquid crystal display (LCD) apparatus is scanned and every frame.

16. A driving apparatus, comprising:

a first amplification unit receiving a first signal and outputting a driving signal of a positive polarity voltage with respect to a reference voltage, the first amplification unit having a first intrinsic offset polarity;

a second amplification unit receiving a second signal and outputting a driving signal of a negative polarity voltage with respect to the reference voltage, the second amplification unit having a second intrinsic offset polarity; and a controller connected to the second amplification unit, the controller having a selector and a storage device and switchable connected to the first amplification unit, the controller configured to apply a chopping signal corresponding to an offset direction of the first amplification unit to a chopping terminal of the second amplification unit to compensate for a difference between the first and the second intrinsic offset polarities such that an offset polarity of an output voltage of the second amplification unit is a same polarity as the first intrinsic offset polarity, even when the first and second intrinsic polarities are different.

17. The driving apparatus as claimed in claim 16, wherein, in a set mode, the selector connects an output of the first amplification unit to the second amplification unit and the storage device stores an output of the second amplification unit, and, in an operation mode, the selector connects the storage device to the second amplification unit.

18. The driving apparatus as claimed in claim 16, wherein the first amplification unit and the second amplification unit operate as comparators and respectively output voltages indicating the first and second intrinsic offset polarities in a set mode, and operate as buffers and output driving voltages corresponding to gradation voltages applied to the first amplification unit and the second amplification unit in an operation mode.

19. The driving apparatus as claimed in claim 16, wherein the first amplification unit is a fixed type buffer and the second amplification unit is one of a first or second type buffer according to the difference between the first and second intrinsic offset polarities.

* * * * *